US011466858B2

(12) United States Patent
Freeman et al.

(10) Patent No.: US 11,466,858 B2
(45) Date of Patent: Oct. 11, 2022

(54) COMBUSTOR FOR A GAS TURBINE ENGINE WITH CERAMIC MATRIX COMPOSITE SEALING ELEMENT

(71) Applicants: Rolls-Royce Corporation, Indianapolis, IN (US); Rolls-Royce North American Technologies Inc., Indianapolis, IN (US)

(72) Inventors: Ted J. Freeman, Danville, IN (US); Aaron D. Sippel, Zionsville, IN (US); Jack D. Petty, Indianapolis, IN (US); Gregory W. Zeaton, Carmel, IN (US)

(73) Assignees: Rolls-Royce Corporation, Indianapolis, IN (US); Rolls-Royce North American Technologies Inc., Indianapolis, IN (US)

( * ) Notice: Subject to any disclaimer, the term of this patent is extended or adjusted under 35 U.S.C. 154(b) by 90 days.

(21) Appl. No.: 16/599,756

(22) Filed: Oct. 11, 2019

(65) Prior Publication Data

US 2021/0108799 A1 Apr. 15, 2021

(51) Int. Cl.
*F23R 3/60* (2006.01)
*F23R 3/28* (2006.01)

(52) U.S. Cl.
CPC ..... *F23R 3/283* (2013.01); *F23R 3/60* (2013.01); *F23R 2900/00012* (2013.01); *F23R 2900/00018* (2013.01)

(58) Field of Classification Search
CPC ..... F23R 3/283; F23R 2900/00012; F23R 2900/00018; F23R 3/60; F23R 3/20; F23R 3/14
See application file for complete search history.

(56) References Cited

U.S. PATENT DOCUMENTS

| | | | | |
|---|---|---|---|---|
| 4,216,652 | A * | 8/1980 | Herman | F23C 7/004 239/400 |
| 4,934,145 | A * | 6/1990 | Zeisser | F23R 3/283 60/740 |
| 5,222,358 | A * | 6/1993 | Chaput | F23R 3/283 60/740 |
| 5,271,219 | A | 12/1993 | Chaput et al. | |
| 5,956,955 | A | 9/1999 | Schmid | |
| 5,996,335 | A | 12/1999 | Ebel | |
| 6,679,063 | B2 | 1/2004 | Ebel | |
| 7,478,534 | B2 | 1/2009 | Guezengar et al. | |
| 7,617,689 | B2 | 11/2009 | Schumacher et al. | |
| 7,665,306 | B2 | 2/2010 | Bronson et al. | |
| 7,690,207 | B2 | 4/2010 | Markarian et al. | |
| 7,775,051 | B2 | 8/2010 | Hernandez et al. | |
| 7,845,174 | B2 | 12/2010 | Parkman et al. | |
| 7,861,530 | B2 | 1/2011 | Hawie et al. | |
| 7,926,280 | B2 | 4/2011 | Morenko et al. | |
| 8,943,835 | B2 | 2/2015 | Corsmeier et al. | |
| 9,222,675 | B2 | 12/2015 | Gerendas | |

(Continued)

*Primary Examiner* — Thomas P Burke

(74) *Attorney, Agent, or Firm* — Barnes & Thornburg LLP

(57) ABSTRACT

A combustor for a gas turbine engine includes a combustor shell, a burner seal, and a burner seal retainer. The combustor shell includes metallic materials and is formed to define an interior combustion space. The burner seal includes ceramic matrix composite materials and is configured to extend through apertures formed in the combustor shell and the heat shield. The burner seal retainer is configured to retain the burner seal to the combustor shell.

7 Claims, 6 Drawing Sheets

(56) References Cited

U.S. PATENT DOCUMENTS

| | | | | |
|---|---|---|---|---|
| 9,243,561 | B2 | 1/2016 | Carlisle | |
| 9,803,869 | B2 | 10/2017 | Clemen et al. | |
| 9,964,309 | B2 | 5/2018 | Corsmeier et al. | |
| 10,041,415 | B2 | 8/2018 | Clemen et al. | |
| 2003/0061815 | A1* | 4/2003 | Young | B23P 6/00 60/752 |
| 2007/0084215 | A1* | 4/2007 | Hernandez | F23R 3/60 60/796 |
| 2007/0269757 | A1* | 11/2007 | Commaret | F23R 3/14 431/351 |
| 2008/0229750 | A1 | 9/2008 | Sipson | |
| 2011/0271682 | A1* | 11/2011 | Sandelis | F23C 7/004 60/737 |
| 2013/0152603 | A1* | 6/2013 | Bunel | F23R 3/60 60/796 |
| 2013/0199194 | A1* | 8/2013 | Carlisle | F23R 3/283 60/772 |
| 2015/0059346 | A1* | 3/2015 | Bunel | F23R 3/14 60/737 |
| 2017/0276356 | A1* | 9/2017 | Mulcaire | F23R 3/002 |
| 2018/0094812 | A1 | 4/2018 | Corsmeier | |
| 2018/0202659 | A1* | 7/2018 | Stieg | F23R 3/007 |
| 2021/0102701 | A1* | 4/2021 | Freeman | F23R 3/50 |

* cited by examiner

COMBUSTOR FOR A GAS TURBINE ENGINE WITH CERAMIC MATRIX COMPOSITE SEALING ELEMENT

FIELD OF THE DISCLOSURE

The present disclosure relates generally to combustors used in gas turbine engines, and more specifically to a combustor including a metallic case and a burner seal.

BACKGROUND

Engines, and particularly gas turbine engines, are used to power aircraft, watercraft, power generators and the like. Gas turbine engines typically include a compressor, a combustor, and a turbine. The compressor compresses air drawn into the engine and delivers high pressure air to the combustor. The combustor is a component or area of a gas turbine engine where combustion takes place. In a gas turbine engine, the combustor receives high pressure air and adds fuel to the air which is burned to produce hot, high-pressure gas. After burning the fuel, the hot, high-pressure gas is passed from the combustor to the turbine. The turbine extracts work from the hot, high-pressure gas to drive the compressor and residual energy is used for propulsion or sometimes to drive an output shaft.

Combustors may include burner seals that locate off the fuel nozzles and contain the burning fuel during operation of a gas turbine engine. The burner seal included in the combustor is designed and built to withstand high-temperatures induced during combustion. In some cases, burner seals may be made from metallic superalloys. Components made of metal alloys often require significant cooling to be maintained at or below their maximum use temperatures. The operational efficiencies of gas turbine engines are sometimes increased with the use of CMC materials that require less cooling and have operating temperatures that exceed the maximum use temperatures of most metal alloys. The reduced cooling required by CMC materials when compared to metal alloy materials can permit greater temperature uniformity and can lead to reduced undesirable emissions.

One challenge relating to the use of CMC materials is that they are sometimes secured to the surrounding metal shell via metal fasteners. Metal fasteners can lose their strength and may even melt at CMC operating temperatures. Since the allowable operating temperature of a metal fastener is typically lower than the allowable operating temperature of the CMC, metal fasteners, and/or the area surrounding it, is often cooled to allow it to maintain its strength. Such configurations may undermine the desired high temperature capability of the CMC. Moreover, challenges arise when the mismatch between thermal expansion of CMC materials and metallic materials is considered. Accordingly, new techniques and configurations are needed for coupling components, such as CMC, to surrounding structures experiencing high-temperature environments.

SUMMARY

The present disclosure may comprise one or more of the following features and combinations thereof.

According to a first aspect of the present disclosure, a combustor for use in a gas turbine engine includes a combustor shell, a burner seal, and a burner seal retainer. The combustor shell includes metallic materials and is adapted to be mounted in the gas turbine engine and is formed to define an interior combustion space. The combustor shell includes an outer annular wall that extends circumferentially around a central reference axis. The combustor shell may further include an inner annular wall arranged radially inward from the outer annular wall to provide the interior combustion space between the outer annular wall and the inner annular wall. The combustor shell may further include a dome panel coupled to axially-forward ends of the outer annular wall and the inner annular wall. In some embodiments, the dome panel is formed to include a plurality of fuel nozzle apertures spaced circumferentially around the central reference axis.

In some embodiments, the burner seal includes ceramic matrix composite materials and is arranged to extend through one of the fuel nozzle apertures included in the plurality of fuel nozzle apertures along a burner seal axis. In some embodiments, the burner seal retainer is configured to couple the burner seal to the dome panel in a fixed axial position In some embodiments, the burner seal retainer is sized to retain the burner seal to the dome panel while allowing the burner seal to float in radial and circumferential directions to accommodate thermal growth of the dome panel and the burner seal retainer at an expansion rate not equal to an expansion rate of the burner seal.

In some embodiments, the burner seal includes a burner seal body with an inlet end and an outlet end spaced axially from the inlet end and an inlet flange located at the inlet end that extends radially outward from the burner seal body relative to the burner seal axis. In some embodiments, the inlet flange is spaced from the burner seal axis a first distance and the fuel nozzle aperture is spaced apart from the burner seal axis a second distance greater than the first distance so that the burner seal is inserted through the fuel nozzle aperture from an aft side of the dome panel.

In some embodiments, the burner seal retainer includes a first retainer half-ring formed to include a first semi-circular channel and a second retainer half-ring formed to include a second semi-circular channel and the inlet flange is received in the first and second semi-circular channels when the burner seal retainer is installed on the burner seal. In some embodiments, an anti-rotation pin extends axially through each retainer half ring and into the inlet flange to block rotation of the burner seal relative to the burner seal retainer about the burner seal axis.

In some embodiments, each retainer half-ring is joined directly to the dome panel to couple the burner seal to the dome panel in the fixed axial position. In some embodiments, each retainer half-ring includes a mount plate coupled to an axially forward surface of the dome panel, a link segment coupled to the mount plate and arranged to extend axially forward from the mount plate, and a retainer plate coupled to the link segment and spaced apart from the mount plate to provide the first and second semi-circular channels axially between the mount plate and the retainer plate.

In some embodiments, the inlet flange has a distal end spaced apart from a radially inner surface of the link segment to provide a gap between the inlet flange and the link segment to accommodate the expansion rate of the burner seal retainer.

In some embodiments, the mount plate has a proximal end and a distal end and an inner radius is defined between the burner seal axis and the proximal end, and the inner radius of the mount plate is less than a radius of the fuel nozzle aperture. In some embodiments, an outer radius of the mount plate is defined between the burner seal axis and the distal end, and the outer radius of the mount plate is greater than the radius of the fuel nozzle aperture.

In some embodiments, the combustor further includes a retainer bracket configured to retain each of the half-rings together to enclose the inlet flange, the retainer bracket including an annular mount ring coupled to the dome panel and a retention panel engaged with the mount plate of each retainer half-ring to couple the burner seal retainer to the dome panel. In some embodiments, an anti-rotation pin extends through the retainer bracket and into at least one of the retainer half-rings to block rotation of the retainer half-rings relative to the retainer bracket about the burner seal axis.

In some embodiments, the retention panel includes a plurality of castellation tabs that extend radially inward toward the burner seal axis and the burner seal retainer includes a plurality of castellation tabs opposite the castellation tabs of the retention panel so that the retainer bracket and the burner seal retainer provide a cam lock when the castellation tabs of the burner seal retainer move past the castellation tabs of the retention panel and the burner seal retainer is rotated relative to the retention panel so that the that the castellation tabs of the burner seal are aligned with the castellation tabs of the burner seal retainer.

In some embodiments, the burner seal retainer further includes a plurality of anti-rotation pins that extend through apertures formed in the castellation tabs of the burner seal retainer and the castellation tabs of the retention panel to block rotation of the burner seal retainer relative to the retention panel.

In some embodiments, the burner seal retainer includes a locator ring with a pair of mount flanges arranged on opposite circumferential sides from one another and a corresponding pair of retainer fastener assemblies each having a fastener and a washer.

In some embodiments, each washer engages the inlet flange of the burner seal and each fastener extends through an aperture formed in the dome panel and receives a corresponding nut to mount the burner seal retainer and the burner seal to the dome panel in the fixed axial position.

According to another aspect of the present disclosure, a method of retaining a burner seal to a dome panel in a combustor of a gas turbine engine includes forming the combustor from metallic materials to define an interior cavity. The combustor includes a dome panel formed to include at least one fuel nozzle aperture that opens into the interior cavity.

In some embodiments, the method further includes inserting the burner seal through the fuel nozzle aperture from an aft side of the dome panel, the burner seal comprising ceramic matrix composite materials.

In some embodiments, the method further includes retaining the burner seal in a fixed axial position while allowing the burner seal to float in radial and circumferential directions to accommodate thermal growth of the dome panel at an expansion rate not equal to an expansion rate of the burner seal.

In some embodiments, the burner seal includes a burner seal body that extends circumferentially around a burner seal axis with an inlet end and an outlet end spaced axially from the inlet end and an inlet flange at the inlet end that extends radially outward from the burner seal body relative to the burner seal axis and the step of retaining the burner seal includes engaging the inlet flange with a burner seal retainer without fixing the burner seal in the radial and circumferential directions.

In some embodiments, the step of engaging the inlet flange includes enclosing the inlet flange with a first retainer half-ring formed to include a first semi-circular channel and a second retainer half-ring formed to include a second semi-circular channel, the inlet flange being received in the first and second semi-circular channels when the burner seal retainer is installed on the burner seal and the first and second retainer half rings engaged with the forward surface of the dome panel to block movement of the burner seal axially aft through the fuel nozzle aperture.

In some embodiments, the step of retaining the burner seal further comprises providing a retainer bracket that engages each retainer half-ring and is coupled to the dome panel to retain the first and second retainer half-rings together.

These and other features of the present disclosure will become more apparent from the following description of the illustrative embodiments.

DETAILED DESCRIPTION OF THE DRAWINGS

Figure 1:
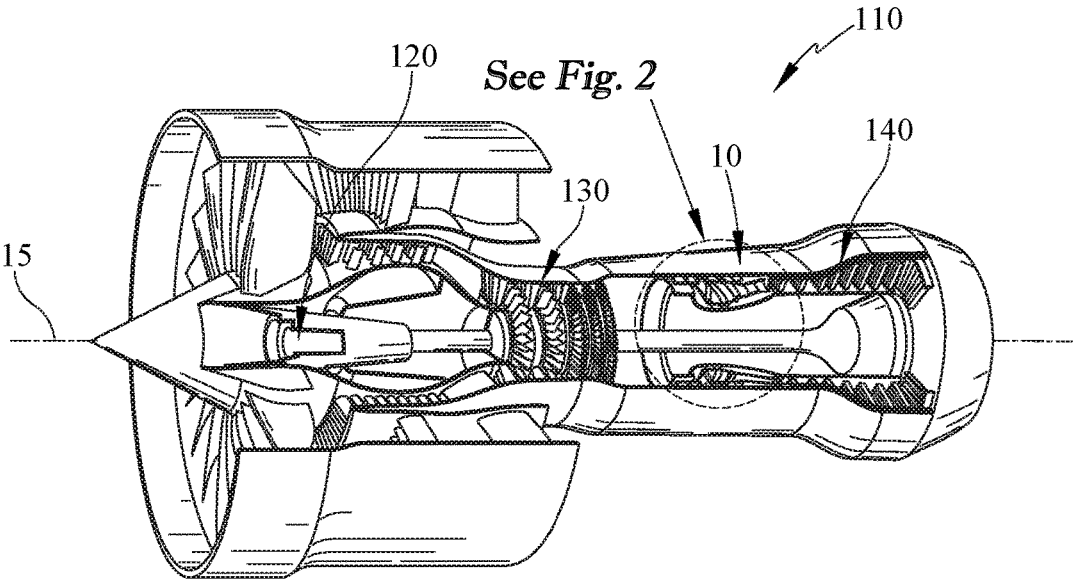
FIG. 1 is a perspective cut-away view of a gas turbine engine showing that the gas turbine engine includes compressor, a combustor, and a turbine.

For the purposes of promoting an understanding of the principles of the disclosure, reference will now be made to a number of illustrative embodiments illustrated in the drawings and specific language will be used to describe the same.

The arrangement of an illustrative combustor 10 in a gas turbine engine 110 is shown in FIG. 1. The gas turbine engine 110 includes a fan 120, a compressor 130, the combustor 10, and a turbine 140. The fan 120 is driven by the turbine 140 during operation of the gas turbine engine 110. The compressor 130 compresses and delivers air to the combustor 10. The combustor 10 mixes fuel with the compressed air received from the compressor 130 and ignites the fuel. The hot, high pressure products of the combustion reaction in the combustor 10 are directed into the turbine 140 and the turbine 140 extracts work to drive the compressor 130 and the fan 120.

Figure 2:
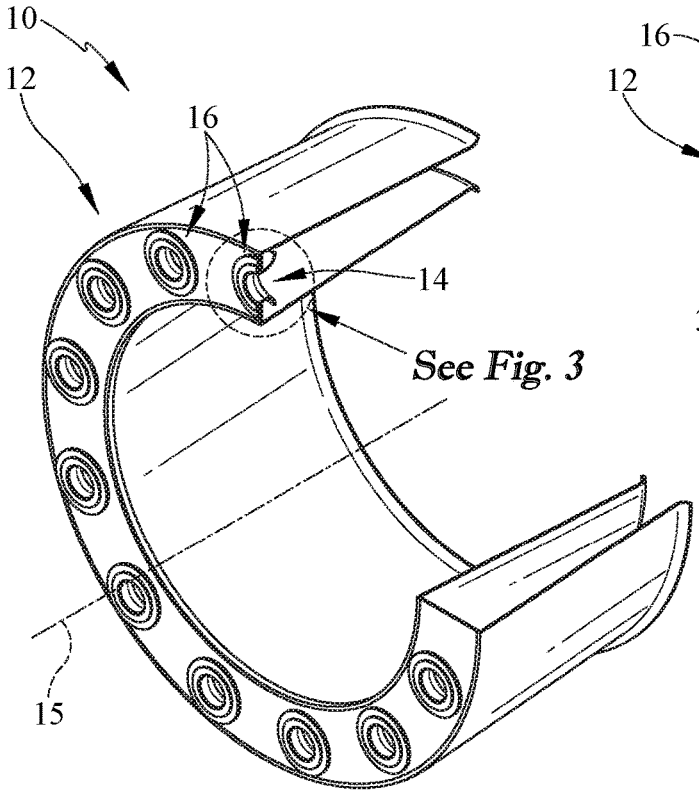
FIG. 2 is a perspective cut away view of the combustor from FIG. 1 showing that the combustor includes a combustor shell that is made from metallic materials and defines an interior combustion space, a plurality of burner seals that are made from CMC material and are arranged to extend through corresponding fuel nozzle apertures formed in the combustor shell, and a plurality of burner seal retainers configured to couple the CMC burner seals to the metallic combustor shell.
Figure 3:
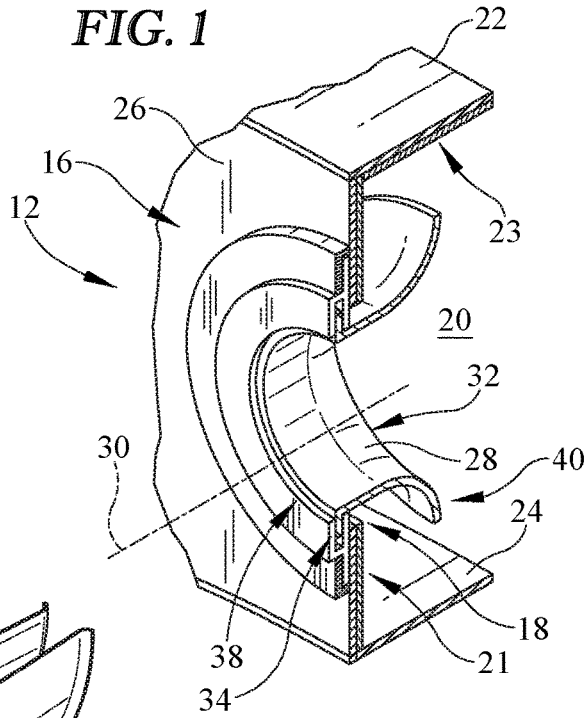
FIG. 3 is an enlarged perspective cutaway view of a portion of the combustor from FIG. 2 showing that each burner seal is shaped to include an inlet flange engaged by a corresponding burner seal retainer to couple the burner seal to the combustor shell.

The combustor 10 is an annular combustor and includes a combustor shell 12, a plurality of burner seals 14 that extend through corresponding fuel nozzle apertures 18 formed in the combustor shell 12, and a burner seal retainer 16 for each burner seal 14 as shown in FIGS. 2 and 3. The combustor shell 12 is adapted to be mounted in the gas turbine engine 110 circumferentially around a central reference axis 15 and defines an interior combustion space 20. One or more dome heat shields 21 (also called meter panels) or combustor liners 23 may be coupled to the combustor shell 12 and dome panel 26 in the interior combustion space 20 to protect the combustor shell 12 from heat generated by fuel burning in the combustor 10. Each burner seal 14 provides an inlet port for a fuel nozzle (not shown) used to spray fuel into the interior combustion space 20 and cause the combustion reaction. The burner seal retainers 16 are configured to retain the burner seals 14 to the combustor shell 12 without forming stresses in either component.

The combustor shell 12 is made from metallic materials while each burner seal 14 is made from ceramic matrix composite (CMC) materials as shown in FIG. 3. During use, the metallic materials have a thermal growth pattern that is disproportional a thermal growth pattern of the CMC materials. In particular, metallic materials have a higher coefficient of thermal expansion than CMC materials which causes the metallic materials to expand at a higher rate when exposed to elevated temperatures.

Each burner seal 14 is allowed to float relative to the combustor shell 12 to accommodate the different rates of thermal expansion between the combustor shell 12 and the burner seals 14. Each burner seal retainer 16 is configured to retain a corresponding burner seal 14 to the combustor shell 12 in a fixed axial position without directly fixing the burner seals 14 to the combustor shell 12 by other means such as rigid fasteners, welding, brazing, or the like. The burner seal retainer 16 is sized to allow movement of the burner seals 14 in radial and circumferential directions. In this way, binding stresses, which may be formed in the CMC materials due to the different rates of thermal expansion, are avoided to increase the durability of the components.

The combustor shell 12 includes an outer annular wall 22, an inner annular wall 24, and a dome panel 26 coupled to axially-forward ends of the outer wall 22 and the inner wall 24 as shown in FIGS. 2 and 3. The outer wall 22 extends circumferentially around the central reference axis 15. The inner wall 24 is arranged radially inward from the outer wall 22 to provide the interior combustion space 20 between the outer wall 22 and the inner wall 24. Each of the fuel nozzle apertures 18 are formed in the dome panel 26 and are spaced circumferentially around the central reference axis 15.

Although the combustor 10 includes a plurality of burner seals 14 and corresponding burner seal retainers 16, each burner seal 14 and each burner seal retainer 16 is identical in the illustrative embodiment. Accordingly, only one burner seal 14 and corresponding burner seal retainer 16 is referred to below.

Figure 4:
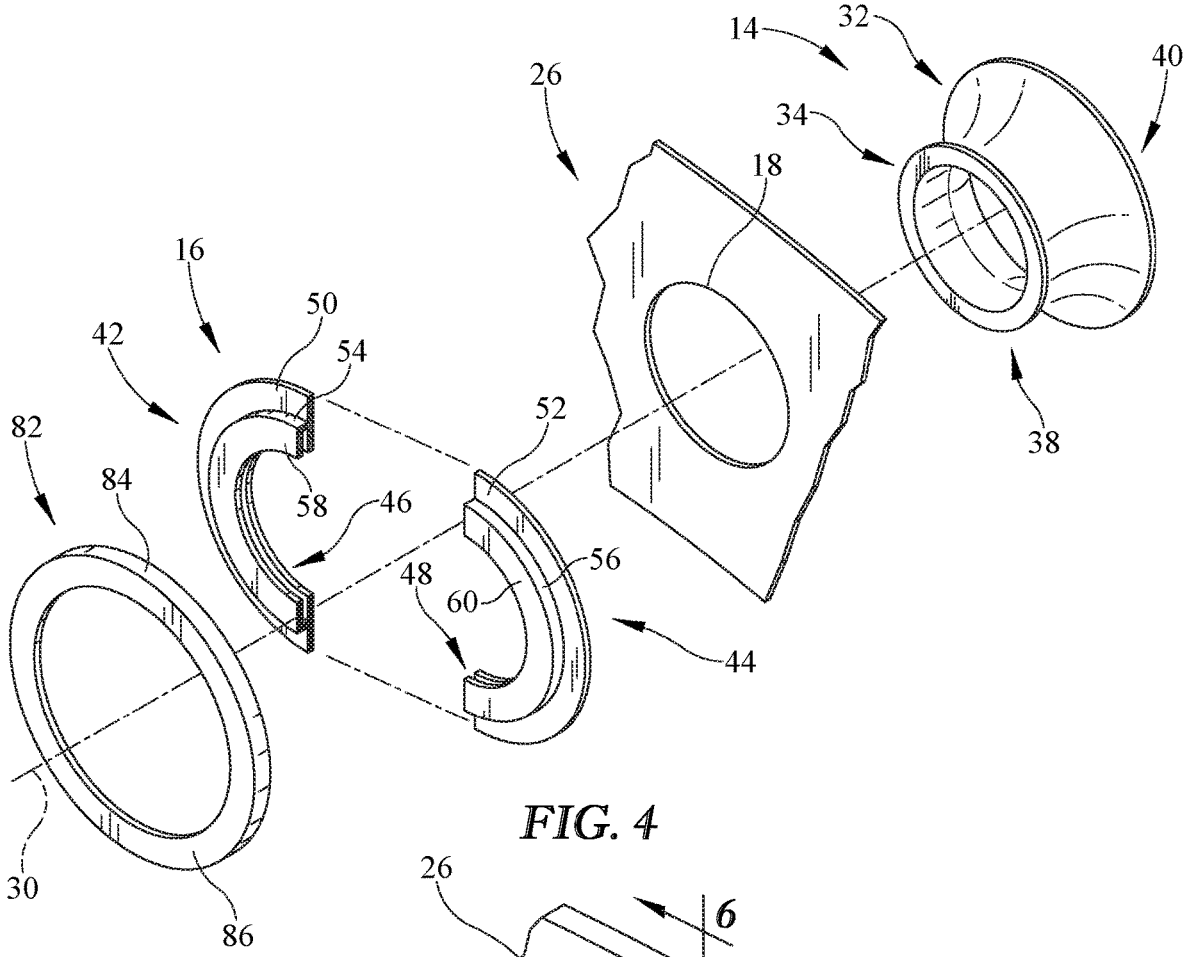
FIG. 4 is an exploded assembly view of a portion of the combustor from FIGS. 1-3 suggesting that the burner seal is configured to be inserted through a fuel nozzle aperture formed in the combustor shell from the aft and the burner seal retainer includes a pair of retainer half-rings that cooperate to form an annular channel that receives the inlet flange of the burner seal when fully assembled as shown in FIG. 5.

The burner seal 14 is sized to be inserted through a corresponding fuel nozzle aperture 18 along a burner seal axis 30 as shown in FIG. 3. The burner seal 14 has an elliptically-shaped inner surface 28 that flares outwardly away from the burner seal axis 30. The burner seal 14 lines and seals the fuel nozzle aperture 18 and may also guide cooling or purge air into the interior combustion space 20 thereby blocking hot gases from reaching edges of the fuel nozzle aperture 18. The burner seal 14 is arranged circumferentially around the burner seal axis 30 and includes a burner seal body 32 and an inlet flange 34 as shown in FIGS. 3 and 4. The burner seal body 32 has an inlet end 38 and an outlet end 40 spaced axially from the inlet end 38 relative to the burner seal axis 30. The inlet flange 34 is located at the inlet end 38 and extends radially outward from the burner seal body 32 relative to the burner seal axis 30.

Figure 5:
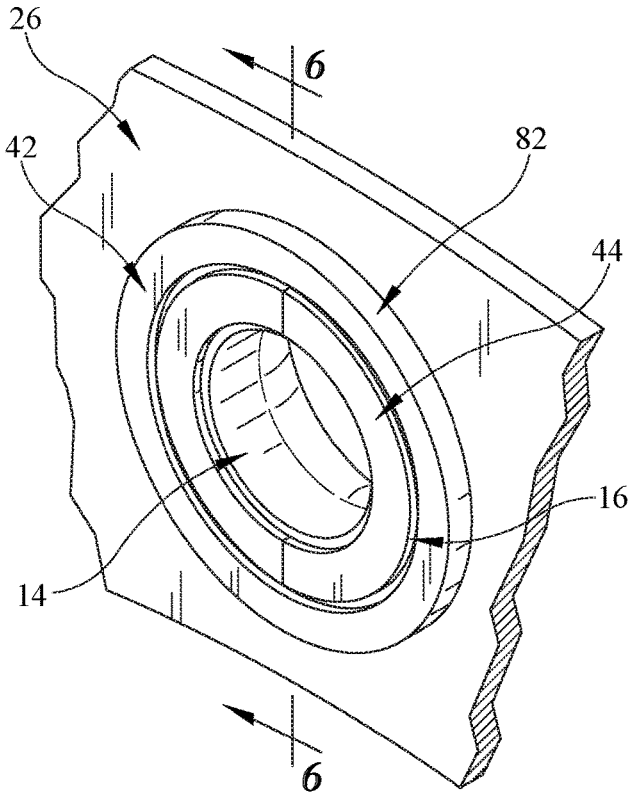
FIG. 5 is a perspective view of the portion of the combustor shown in FIG. 4 assembled showing the burner seal coupled to the combustor shell by the burner seal retainer and a retainer bracket engaging an outer mount plate of the burner seal retainer.

The burner seal retainer 16 is configured to couple the burner seal 14 to the dome panel 26 as shown in FIGS. 3 and 5. The burner seal retainer 16 is made from metallic materials and engages the inlet flange 34 of the burner seal 14 on an axially forward side of the dome panel 26 outside of the interior combustion space 20. The burner seal retainer 16 couples the burner seal 14 to the dome panel 26 in a fixed axial position relative to the burner seal axis 30 to block the burner seal 14 from falling into the interior combustion space 20. The burner seal 14 is sized relative to the dome panel 26 and burner seal retainer 16 such that the burner seal 14 is floating in radial and circumferential directions relative to the burner seal axis 30. This allows movement of the burner seal 14 radially and circumferentially relative to the dome panel 26 and/or the burner seal retainer 16 as the dome panel 26 and the burner seal retainer 16 grow thermally at an expansion rate not equal to an expansion rate of the burner seal 14.

The burner seal retainer 16 includes a first retainer half-ring 42 and a second retainer half-ring 44 as shown in FIGS. 4 and 5. The first retainer half-ring 42 is formed to include a first semi-circular channel 46 and the second retainer half-ring 44 is formed to include a second semi-circular channel 48. Together, the first and second semi-circular channels 46, 48 form a continuous annular channel that receives the inlet flange 34 when the burner seal retainer 16 is installed to couple the burner seal 14 to the dome panel 26.

In some embodiments, more than two retainer rings may be used with each having a channel that forms the continuous annular channel when they are combined.

Figure 6:
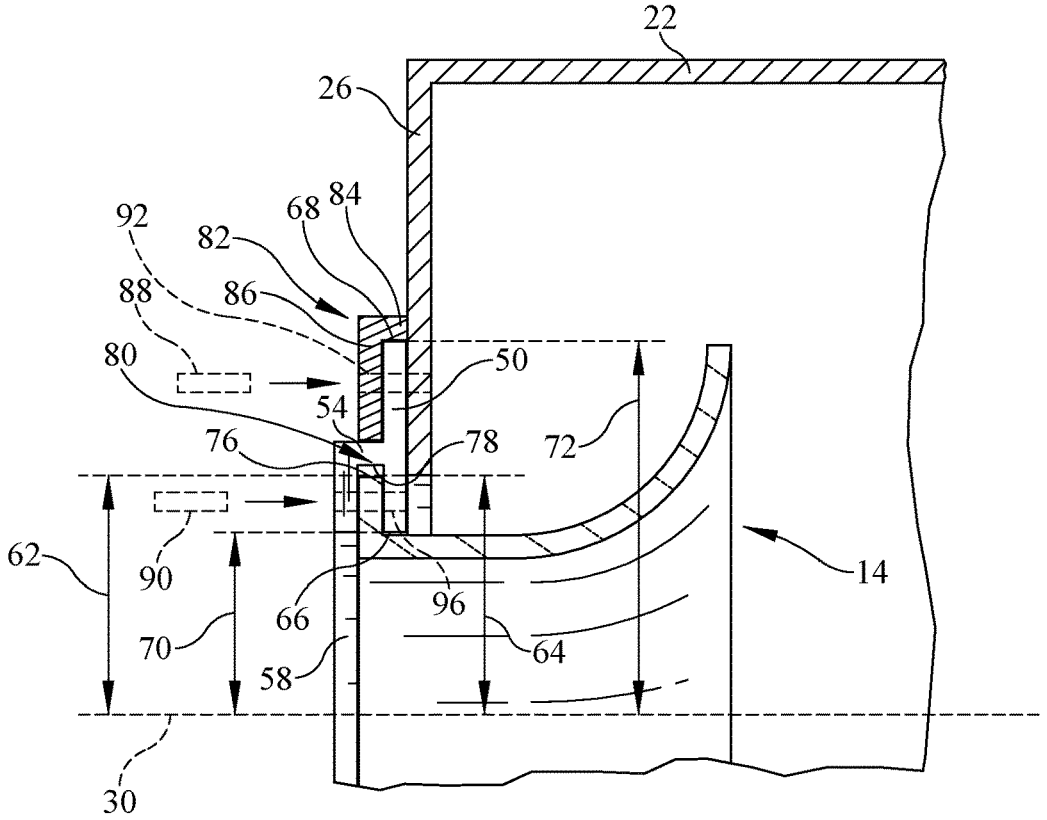
FIG. 6 is a cross sectional view of the combustor taken along line 6-6 in FIG. 5 to show the inlet flange retained in a fixed axial position by the burner seal retainer and showing that the burner seal retainer is coupled to the combustion shell by the retainer bracket.

Each retainer half-ring 42, 44 includes a mount plate 50, 52, a link segment 54, 56, and a retainer plate 58, 60 as shown in FIG. 4-6. The mount plate 50, 52 is coupled to an axially forward surface of the dome panel 26 when the burner seal retainer 16 is fully installed. The link segment 54, 56 is coupled to the mount plate 50, 52 and is arranged to extend axially forward from the mount plate 50, 52. The retainer plate 58, 60 is coupled to the link segment 54, 56 and is spaced apart from the mount plate 50, 52 to provide the first and second semi-circular channels 46, 48 axially between the mount plate 50, 52 and the retainer plate 58, 60.

The inlet flange 34 of the burner seal 14 has an outer diameter spaced apart from the burner seal axis 30 by a first distance 62. The fuel nozzle aperture 18 is spaced apart from the burner seal axis 30 by a second distance 64 as shown in FIG. 6. The second distance 64 is greater than the first distance 62 so that the burner seal 14 can be inserted through the fuel nozzle aperture 18 from an aft side of the dome panel 26. Once fully inserted, the inlet flange 34 protrudes axially forward past the dome panel 26 and the first and second retainer half-rings 42, 44 are positioned around the inlet flange 34 to enclose the inlet flange 34. In some embodiments, the inlet flange 34 has a distal end 76 spaced apart from a radially inner surface 78 of the link segment 54, 56. This provides a gap 80 between the inlet flange 34 and the link segment 54, 56 to accommodate the different expansion rate of the burner seal retainer 16.

The inlet flange 34 and the burner seal retainer 16 cooperate to block axial movement of the burner seal 14 relative to the dome panel 26 along the burner seal axis 30. All of this is done without any holes being drilled into the burner seal 14 and subsequently retained to the dome panel 26 with fasteners or other means that could affect the strength or durability of the burner seal 14. Each mount plate 50, 52 has a proximal end 66 and a distal end 68. An inner radius 70 is defined between the burner seal axis 30 and the proximal end 66. The inner radius 70 of the mount plates 50, 52 is less than the second distance 64 which is equal to a radius of the fuel nozzle aperture 18. An outer radius 72 of the mount plates 50, 52 is defined between the burner seal axis 30 and the distal end 68. The outer radius 72 of the mount plates 50, 52 is greater than the second distance 64.

In the illustrative embodiment, the combustor 10 further includes a retainer bracket 82 configured to retain the first and second retainer half-rings 42, 44 together after they enclose the inlet flange 34 as shown in FIGS. 3 and 6. The retainer bracket 82 is made from metallic materials and includes a mount ring 84 and a retention panel 86. The mount ring 84 is coupled to the dome panel 26 by welding, brazing, or another suitable metal joining process. The retention panel 86 is engaged with the mount plate 50, 52 of each retainer half-ring 42, 44 to couple the burner seal retainer 16 to the dome panel 26.

Anti-rotation pins 88, 90 may be provided to block rotation of the burner seal 14 and/or the burner seal retainer 16 about the burner seal axis 30 as shown in FIG. 6. A first anti-rotation pin 88 is arranged to extend axially through apertures 92 formed in at least one retainer half-ring 42, 44 and into the inlet flange 34 to block rotation of the burner seal 14 relative to the burner seal retainer 16 about the burner seal axis 30. A second anti-rotation pin 90 is arranged to extend through an aperture 96 in the retainer bracket 82 and into at least one of the retainer half-rings 42, 44 to block rotation of the retainer half-rings 42, 44 relative to the retainer bracket 82 and about the burner seal axis 30. Alternatively, the burner seal retainer 16 may be designed so that the retainer bracket 82 provides an interference fit with the burner seal retainer 16 to block rotation of the burner seal retainer 16 relative to the retainer bracket 82.

Figure 7:
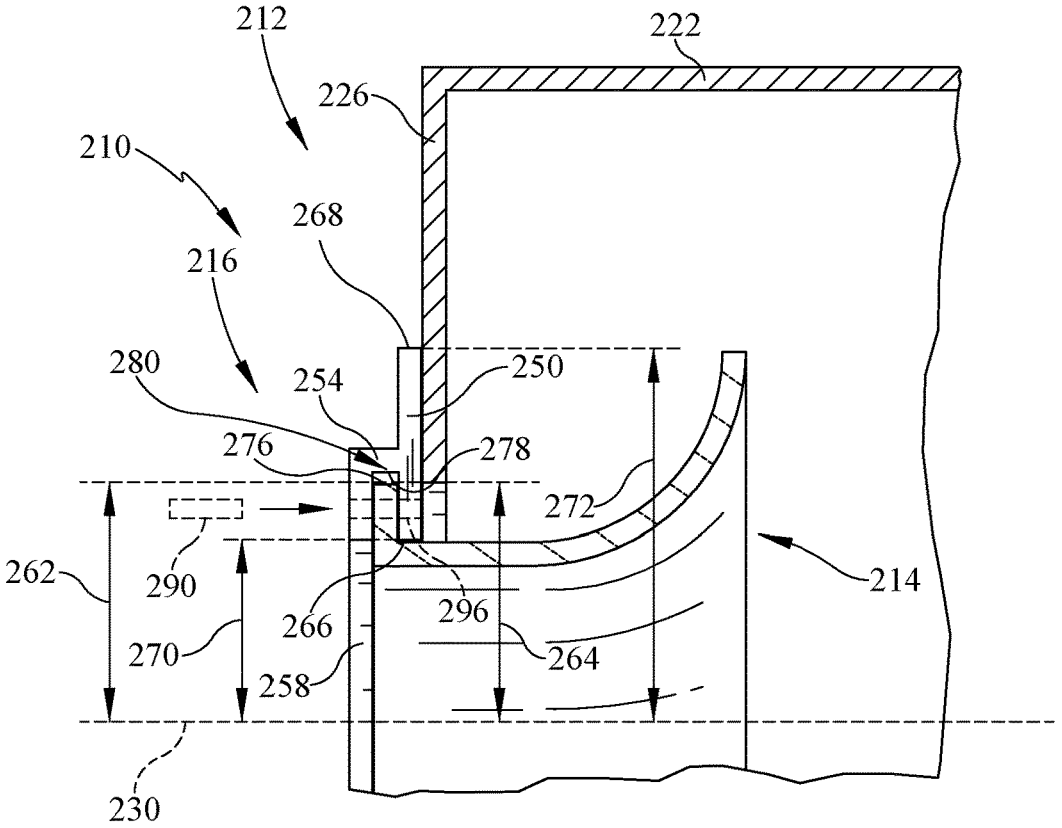
FIG. 7 is a cross sectional view of another embodiment of a combustor similar to the combustor shown in FIG. 5 but without a retainer bracket such that the burner seal retainer is coupled directly to the combustor shell.

Another embodiment of a combustor 210 is shown in FIG. 7. Combustor 210 is substantially similar to combustor 10. Similar reference numbers in the 200 series are used to describe similar features between combustor 10 and combustor 210, such as outer wall 222, dome panel 226, distal end 268, link segment 254, gap 280, distal end 276, first distance 262, second distance 264, inner radius 270, proximal end 266, retainer plate 258, aperture 296, outer radius 272, radially inner surface 278, and mount plate 250. Accordingly, the description above related to combustor 10 is incorporated herein for combustor 210 and differences between combustor 10 and combustor 210 are discussed below.

The combustor 210 includes a combustor shell 212, a burner seal 214, and a burner seal retainer 216. However, combustor 210 does not include a retainer bracket to couple the burner seal retainer 216 to the combustor shell 212. Instead the burner seal retainer 216 is coupled directly to the combustor shell 212 after installing the burner seal 214. The burner seal retainer 216 may be joined to the combustor shell 212 by welding, brazing, soldering, or any other suitable metal joining process. An anti-rotation pin 290 may be used to block rotation of the burner seal 214 relative to the burner seal retainer 216 about burner seal axis 230.

Figure 8:
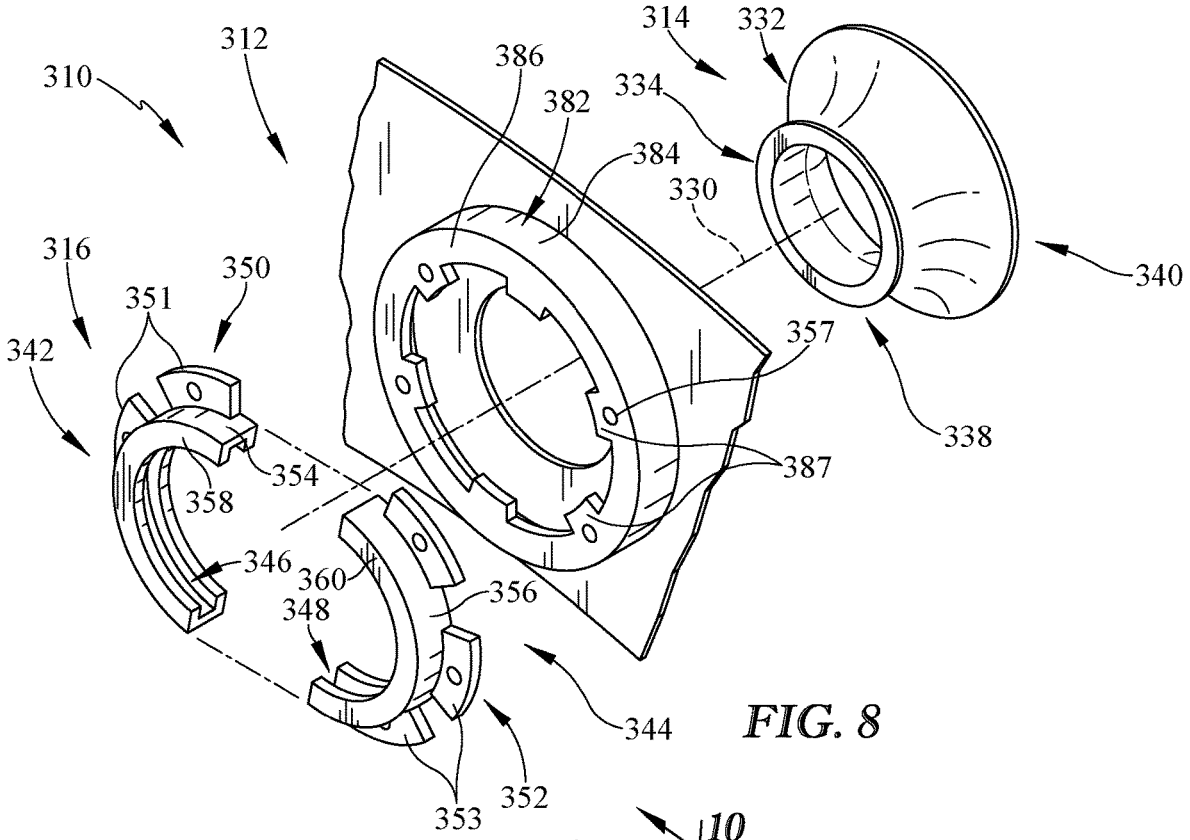
FIG. 8 is an exploded assembly view of a portion of another combustor including a combustor shell, a burner seal, and a burner seal retainer with a plurality of castellation tabs and a retainer bracket coupled to the combustor shell with a plurality of castellation tabs that positively match the castellation tabs of the burner seal retainer.
Figure 9:
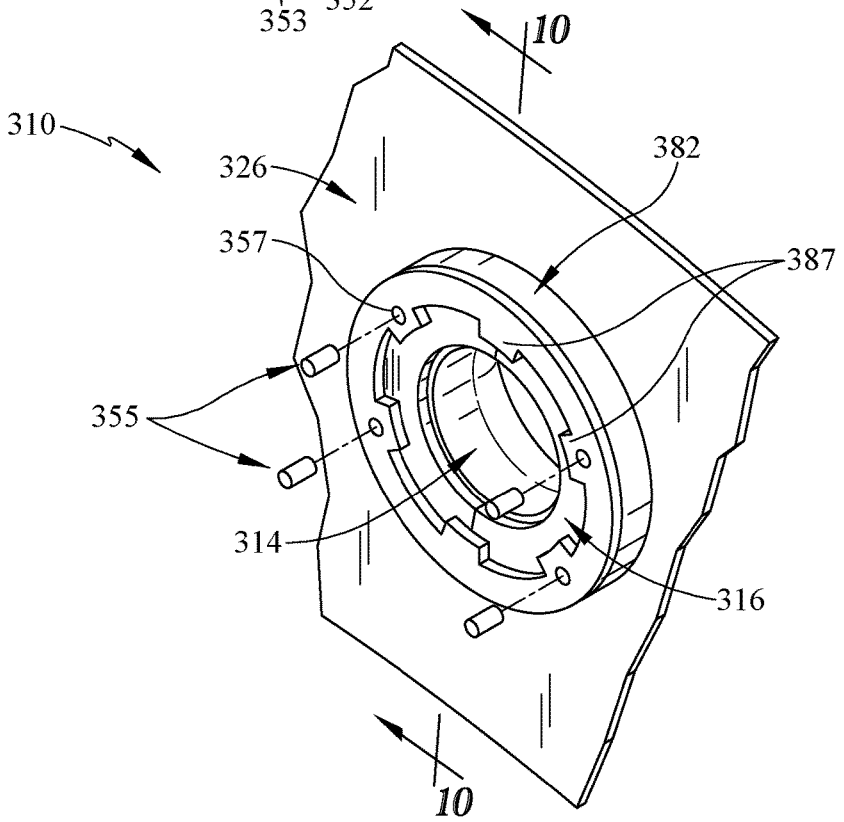
FIG. 9 is a perspective view of the portion of the combustor from FIG. 8 assembled and suggesting that the burner seal retainer may be rotated relative to the retainer bracket until the castellation tabs are in an interference relationship with one another and then secured with anti-rotation pins to couple the burner seal to the combustor shell.
Figure 10:
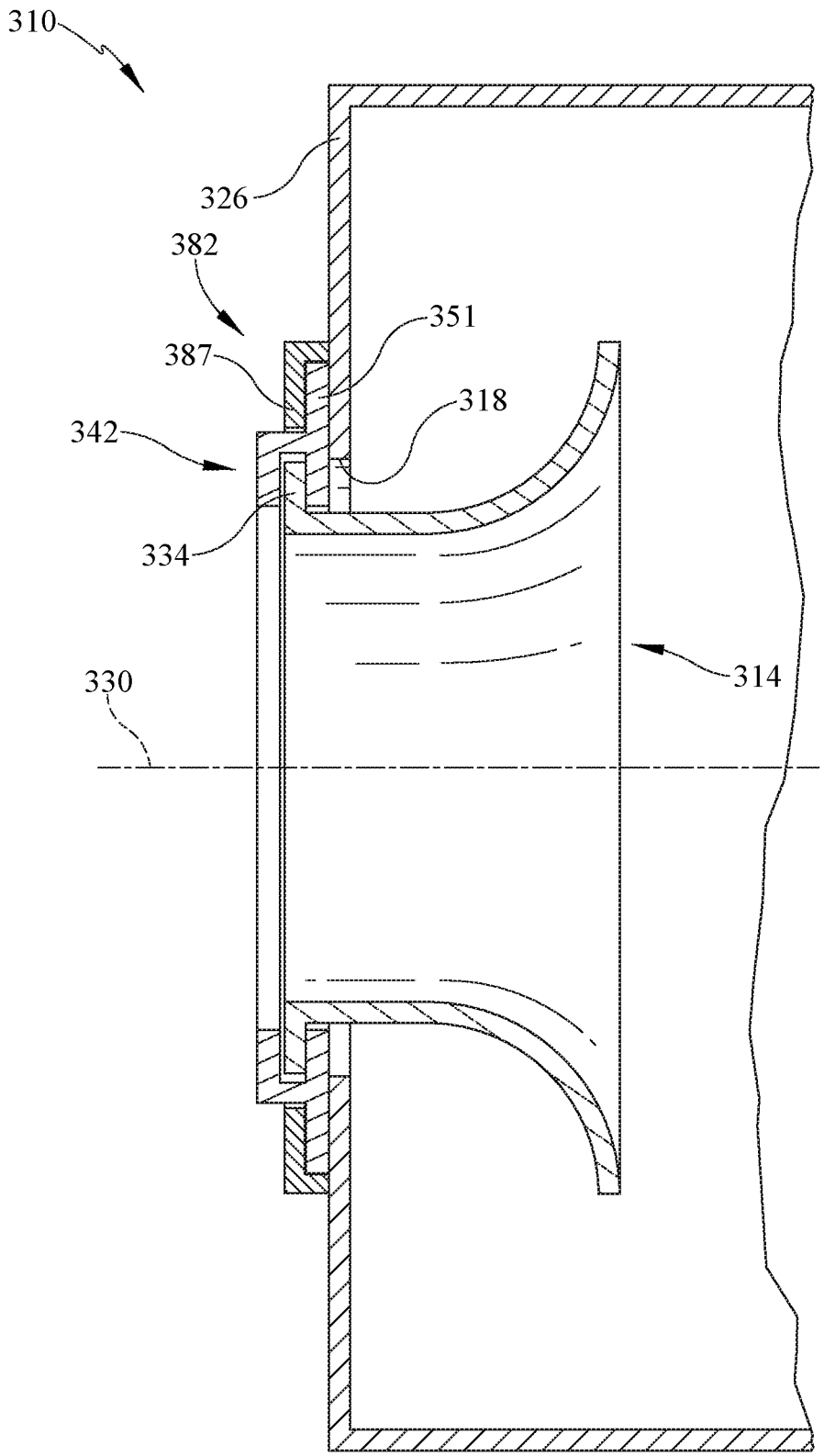
FIG. 10 is a cross sectional view of the portion of the combustor taken along line 10-10 in FIG. 9 showing the castellation tabs of the burner seal retainer and the castellation tabs of the retainer bracket cooperating in the interference relationship to retain the burner seal retainer to the combustor shell.

Another embodiment of a combustor 310 is shown in FIGS. 8-10. The combustor 310 includes a combustor shell 312, a burner seal 314, and a burner seal retainer 316. Combustor 310 is substantially similar to combustor 10. Similar reference numbers in the 300 series are used to describe similar features between combustor 10 and combustor 310. Accordingly, the description above related to combustor 10 is incorporated herein for combustor 310 and differences between combustor 10 and combustor 310 are discussed below.

The combustor shell 312 includes a dome panel 326. A fuel nozzle aperture 318 is formed in the dome panel 326. Although only one fuel nozzle aperture 318 is shown in FIGS. 8-10, the dome panel 326 includes a plurality of fuel nozzle apertures 318 spaced circumferentially around the central reference axis 15.

The burner seal 314 is sized to be inserted through fuel nozzle aperture 318 along a burner seal axis 330 as shown in FIG. 8. The burner seal 314 is arranged circumferentially around the burner seal axis 330 and includes a burner seal body 332 and an inlet flange 334. The burner seal body 332 has an inlet end 338 and an outlet end 340 spaced axially from the inlet end 338 relative to the burner seal axis 330. The inlet flange 334 is located at the inlet end 338 and extends radially outward from the burner seal body 332 relative to the burner seal axis 330.

The burner seal retainer 316 is configured to couple the burner seal 314 to the dome panel 326 as shown in FIGS. 9 and 10. The burner seal retainer 316 is made from metallic materials and engages the inlet flange 334 of the burner seal 314 on an axially forward side of the dome panel 326. The burner seal retainer 316 includes a first retainer half-ring 342 and a second retainer half-ring 344. The first retainer half-ring 342 is formed to include a first semi-circular channel 346 and the second retainer half-ring 344 is formed to include a second semi-circular channel 348. Together, the first and second semi-circular channels 346, 348 form a continuous annular channel that receives the inlet flange 334 when the burner seal retainer 316 is installed to couple the burner seal 314 to the dome panel 326.

Each retainer half-ring 342, 344 includes a mount plate 350, 352, a link segment 354, 356, and a retainer plate 358, 360 as shown in FIG. 8. The mount plate 350, 352 is coupled to the dome panel 326 when the burner seal retainer 316 is installed. The inlet flange 334 and the burner seal retainer 316 cooperate to block axial movement of the burner seal 314 relative to the dome panel 326 along the burner seal axis 330.

In the illustrative embodiment, the combustor 10 further includes a retainer bracket 382 configured to retain the first and second retainer half-rings 342, 344 together after they enclose the inlet flange 334 as shown in FIGS. 9 and 10. The retainer bracket 382 is made from metallic materials and includes a mount ring 384 and a retention panel 386. The mount ring 384 is coupled to the dome panel 326 by welding, brazing, or another suitable metal joining process. When fully installed, the retention panel 386 is engaged with the mount plate 350, 352 of each retainer half-ring 342, 344 to couple the burner seal retainer 316 to the dome panel 326.

To install the burner seal 314, the burner seal 314 is inserted through the fuel nozzle aperture 318 from an aft side of the dome panel 326 until inlet flange 334 protrudes axially forward of the retainer bracket 382. The retainer half rings 342, 344 are then positioned to enclose the inlet flange 334. The retention panel 386 includes a plurality of castellation tabs 387 that extend radially inward toward the burner seal axis 330 as shown in FIG. 8. The mount plates 350, 352 include a plurality of castellation tabs 351, 353 opposite the castellation tabs 387 of the retention panel 386. With the inlet flange enclosed by the retainer half-rings 342, 344, the burner seal retainer 316 is translated aft so that castellation tabs 351, 353 move between and past castellation tabs 387.

The retainer bracket 382 and the burner seal retainer 316 cooperate to provide a cam lock when castellation tabs 351, 353 move past castellation tabs 387 and the burner seal retainer 316 is rotated relative to the retention panel 382 so that the that castellation tabs 351, 353 are aligned with castellation tabs 387. The burner seal 314 and the burner seal retainer 316 are then fixed axially by being located axially between castellation tabs 387 and dome panel 326. Anti-rotation pins 355 may be inserted in to apertures 357 formed in one or more of the castellation tabs to block rotation of the burner seal retainer 316 relative to the retainer bracket 382.

Figure 11:
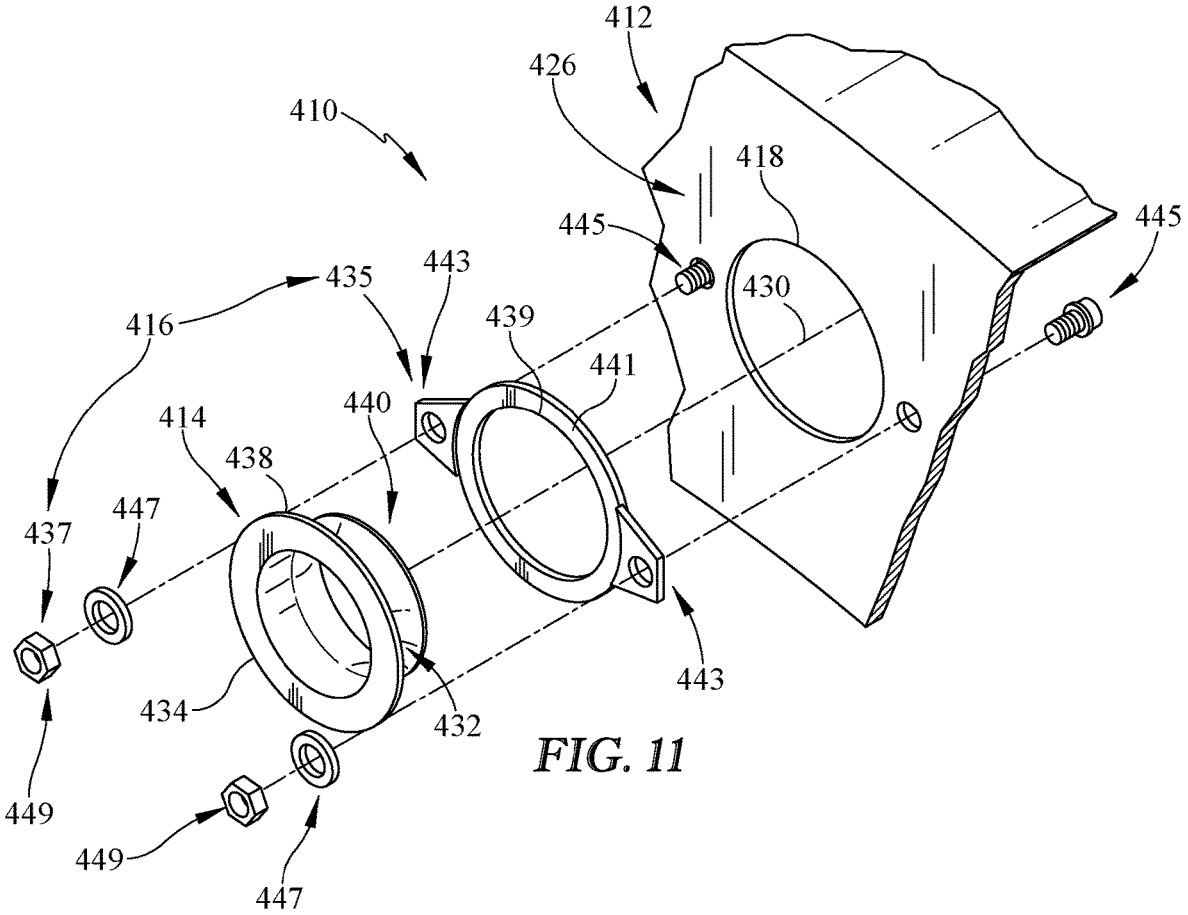
FIG. 11 is an exploded assembly view of a portion of another combustor including a combustor shell, a burner seal, and a burner seal retainer with a locator ring and a pair of retainer assemblies.
Figure 12:
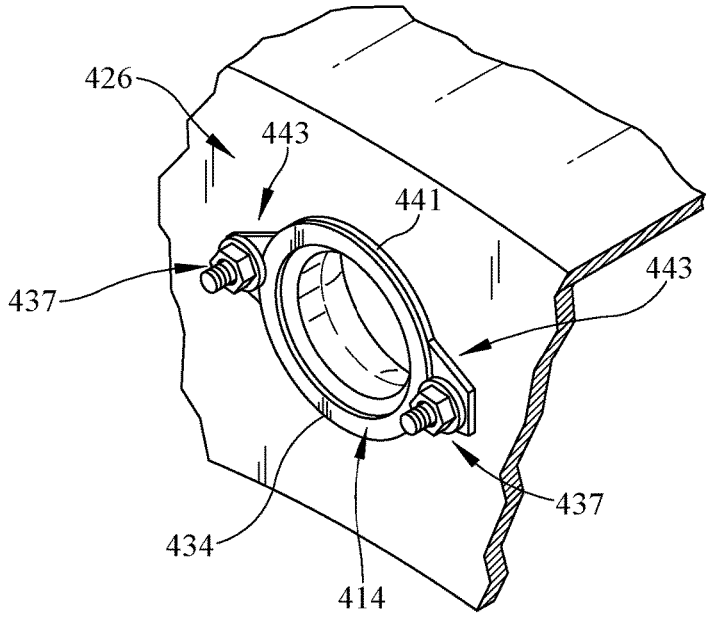
FIG. 12 is a perspective view of the portion of the combustor from FIG. 11 assembled and showing that the pair of retainer assemblies include a washer that partially overlaps a portion of the burner seal to retain the burner seal to the combustor shell.

Another embodiment of a combustor 410 is shown in FIGS. 11 and 12. The combustor 410 includes a combustor shell 412, a burner seal 414, and a burner seal retainer 416. Combustor 410 is substantially similar to combustor 10. Similar reference numbers in the 400 series are used to describe similar features between combustor 10 and combustor 410. Accordingly, the description above related to combustor 10 is incorporated herein for combustor 410 and differences between combustor 10 and combustor 410 are discussed below.

The combustor shell 412 includes a dome panel 426. A fuel nozzle aperture 418 is formed in the dome panel 426. Although only one fuel nozzle aperture 418 is shown in FIGS. 11 and 12, the dome panel 426 includes a plurality of fuel nozzle apertures 418 spaced circumferentially around the central reference axis 15.

The burner seal 414 is sized to be inserted through fuel nozzle aperture 418 along a burner seal axis 430 as shown in FIG. 11. The burner seal 414 is arranged circumferentially around the burner seal axis 430 and includes a burner seal body 432 and an inlet flange 434. The burner seal body 432 has an inlet end 438 and an outlet end 440 spaced axially from the inlet end 438 relative to the burner seal axis 430. The inlet flange 434 is located at the inlet end 438 and extends radially outward from the burner seal body 432 relative to the burner seal axis 430.

The burner seal retainer 416 is configured to couple the burner seal 414 to the dome panel 426 as shown in FIGS. 11 and 12. The burner seal retainer 416 is made from metallic materials and engages the inlet flange 434 of the burner seal 414 on an axially forward side of the dome panel 426. The burner seal retainer 416 includes a locator ring 435 and a pair of retainer assemblies 437. The locator ring 435 is formed to include a burner seal aperture 439. The burner seal 414 is configured to be inserted through the burner seal aperture 439 and the fuel nozzle aperture 418 to mount the burner seal 414 to the dome panel 426. The retainer assemblies 437 mount the locator ring 435 to the dome panel 426 and at least partially engage the burner seal 414 to fix the burner seal 414 axially.

The locator ring 435 includes a body ring 441 and a pair of mount flanges 443 arranged on opposite circumferential sides from one another on the body ring 441. The body ring 441 has an outer diameter that matches an outer diameter of the inlet flange 434. Both of the mount flanges 443 are at least partially offset axially from the body ring 441. The offset matches a thickness of the inlet flange so that the inlet flange 434 is flush with the mount flanges 443 when installed.

Each retainer assembly 437 includes a fastener 445, a washer 447, and a nut 449. Each fastener 445 extends through an aperture formed in a corresponding mount flange 443 and the dome panel 426 and receives nut 449 to couple the locator ring 435 to the dome panel 426. Each washer 447 is located between a head of the fastener 445 and the mount flange 443 and extends outwardly from the fastener to overlap with the inlet flange 434. In this way, the washers 447 retain the burner seal 414 to the locator ring 435 and the dome panel 426.

The ceramic matrix composite materials in the illustrative embodiments described herein may comprise silicon carbide fibers suspended in a silicon carbide matrix (SiC—SiC CMC), however, any suitable ceramic matrix composite composition may be used. The burner seals are made from silicon carbide fiber preforms that are infiltrated with ceramic matrix material. The fiber preforms may be a two-dimensional ply preform or a three-dimensionally woven or braided preform. Prior to infiltration, the preforms may be molded into a desired shape. Once molded into the desired shape, the fiber preforms are infiltrated with ceramic matrix material through chemical vapor infiltration to solidify and/or densify the fibers. The fiber preforms may be also be processed through other suitable processes such as slurry infiltration, melt infiltration and/or polymer infiltration and pyrolysis. Once densified, the finished ceramic matrix composite component may be machined to finalize the desired shape.

In some embodiments, the combustor in a gas turbine operates at extremely high temperatures and, thus, challenges the capabilities of metallic alloys that are used to form the combustion chamber. SiC—SiC CMC may offer a higher temperature option to deal with this extreme environment. In addition, as environmental regulations on gas turbine emissions (ICAO regulations) become increasingly stringent over time, a greater fraction of the air entering the combustor may be needed for emissions control/reduction features in order to have a compliant engine design. As such, a smaller fraction of air may be available for adequate wall cooling in future combustors. The higher temperature-capable CMC material offers the capability of using less of the combustor air for cooling the structure. One location that may benefit from such a material change is the burner seal. The fuel nozzle inserts into the burner seal. The seal is fixed axially but is allowed to float in the radial and circumferential directions so as not to over constrain the fuel nozzle. One way of implementing a CMC burner seal is to hold it without allowing for too much movement due to the coefficient of thermal expansion mis-match.

In some embodiments, a funnel shaped burner seal (or other shape designated by aero considerations) is inserted through the dome panel from the aft face forward as shown in FIGS. 1-10. The hole in the dome panel being sized to allow the burner seal inserted from the aft. Once inserted, retaining half rings (that are larger than the hole in the dome panel) are placed around the burner seal trapping it from being able to be removed. The retaining rings would then be retained axially by one or more metal brackets being welded to the dome panel (anti-rotation features may be required in both the burner seal and in the retaining rings as shown in FIG. 6). The retaining half rings may also be welded directly to the dome panel as shown in FIG. 7.

In some embodiments, the retaining brackets or half-rings include castellated features that engage with equivalent but negative features in the dome panel to form a cam-lock arrangement as shown in FIGS. 8-10. An anti-rotation pin may then be affixed to keep the cam-lock feature from coming undone. In some embodiments, a snap ring or retaining rings could be used to ensure the clam shell brackets stay together (assuming the dome panel radial surfaces will not be tight on the brackets to keep them together). In some embodiments, the burner seal may be inserted from the front of the dome panel and retained with a plurality of bolt/washer assemblies as shown in FIGS. 11 and 12. Cooling holes in the actual burner seal may be removed to avoid machining holes into the CMC. It is possible that this could be accomplished by modifying the hole pattern in the locating ring.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A combustor for use in a gas turbine engine, the combustor comprising a combustor shell comprising metallic materials adapted to be mounted in a gas turbine engine and formed to define an interior combustion space, the combustor shell including an outer annular wall that extends circumferentially around a central reference axis, an inner annular wall arranged radially inward from the outer annular wall to provide the interior combustion space between the outer annular wall and the inner annular wall, and a dome panel coupled to axially-forward ends of the outer annular wall and the inner annular wall, the dome panel being formed to include a plurality of fuel nozzle apertures spaced circumferentially around the central reference axis, a burner seal comprising ceramic matrix composite materials and arranged to extend through one of the fuel nozzle apertures included in the plurality of fuel nozzle apertures along a burner seal axis, wherein the burner seal includes a burner seal body with an inlet end and an outlet end spaced axially from the inlet end and an inlet flange located at the inlet end that extends radially outward from the burner seal body relative to the burner seal axis, a heat shield arranged along an axially aft surface of the dome panel within the interior combustion space, the heat shield being formed to include a heat shield aperture that receives the burner seal, a burner seal retainer configured to engage the inlet flange of the burner seal to couple the burner seal to an axially forward surface of the dome panel in a fixed axial position, wherein the burner seal retainer is sized to retain the burner seal to the dome panel while allowing the burner seal to float in radial and circumferential directions to accommodate thermal growth of the dome panel and the burner seal retainer at an expansion rate not equal to an expansion rate of the burner seal, wherein the burner seal retainer includes a first retainer half-ring formed to include a first semi-circular channel and a second retainer half-ring formed to include a second semi-circular channel and the inlet flange is received in the first and second semi-circular channels when the burner seal retainer is installed on the burner seal, wherein each retainer half-ring includes a mount plate coupled to the axially forward surface of the dome panel, a link segment coupled to the mount plate and arranged to extend axially forward from the mount plate, and a retainer plate coupled to the link segment and spaced apart from the mount plate to provide the first and second semi-circular channels axially between the mount plate and the retainer plate, and wherein an outer radius of the mount plate is defined between the burner seal axis and a distal end of the mount plate, and the outer radius of the mount plate is greater than the radius of the fuel nozzle aperture and an outer radius of the link segment and the retainer plate, wherein a first anti-rotation pin extends axially through the retainer plate of at least one of the retainer half-rings and into the inlet flange to block rotation of the burner seal relative to the burner seal retainer about the burner seal axis, wherein the combustor further comprises a retainer bracket configured to retain each of the retainer half-rings together to enclose the inlet flange, the retainer bracket including an annular mount ring that extends axially from a first end to a second end fixed to the dome panel and a retention panel fixed to the first end of the annular mount ring and that extends radially inward toward the burner seal axis, wherein the retention panel of the retainer bracket has an aft surface engaged with a forward surface of the mount plate of each retainer half-ring, and wherein a second anti-rotation pin extends axially through the retention panel of the retainer bracket, the mount plate of at least one retainer half-ring, and into the dome panel.

2. The combustor of claim 1, wherein the outlet end has an outer diameter greater than the inlet end, the fuel nozzle aperture, and the heat shield aperture.

3. A combustor for use in a gas turbine engine, the combustor comprising a combustor shell comprising metallic materials adapted to be mounted in a gas turbine engine and formed to define an interior combustion space, the combustor shell including an outer annular wall that extends circumferentially around a central reference axis, an inner annular wall arranged radially inward from the outer annular wall to provide the interior combustion space between the outer annular wall and the inner annular wall, and a dome panel coupled to axially-forward ends of the outer annular wall and the inner annular wall, the dome panel being formed to include a plurality of fuel nozzle apertures spaced circumferentially around the central reference axis, a burner seal comprising ceramic matrix composite materials and arranged to extend through one of the fuel nozzle apertures included in the plurality of fuel nozzle apertures along a burner seal axis, wherein the burner seal includes a burner seal body extending axially from an axially-forwardmost, inlet end to an axially-aftmost, outlet end and an inlet flange located at the axially-forwardmost, inlet end that extends radially outward from the burner seal body relative to the burner seal axis, and a burner seal retainer configured to engage the inlet flange of the burner seal to couple the burner seal to an axially forward surface of the dome panel in a fixed axial position, wherein the burner seal retainer is sized to retain the burner seal to the dome panel while allowing the burner seal to float in radial and circumferential directions to accommodate thermal growth of the dome panel and the burner seal retainer at an expansion rate not equal to an expansion rate of the burner seal, wherein the inlet flange is spaced from the burner seal axis a first distance and a portion of the dome panel defining the fuel nozzle aperture is spaced apart from the burner seal axis a second distance greater than the first distance so that the burner seal is inserted through the fuel nozzle aperture from an aft side of the dome panel, and wherein the burner seal retainer includes a first retainer half-ring formed to include a first semi-circular channel and a second retainer half-ring formed to include a second semi-circular channel and the inlet flange is received in the first and second semi-circular channels when the burner seal retainer is installed on the burner seal, wherein each retainer half-ring includes a mount plate coupled to the axially forward surface of the dome panel, a link segment coupled to the mount plate and arranged to extend axially forward from the mount plate, and a retainer plate coupled to the link segment and spaced apart from the mount plate to provide the first and second semi-circular channels axially between the mount plate and the retainer plate, wherein a first anti-rotation pin extends axially through the retainer plate of at least one of the retainer half-rings and into the inlet flange to block rotation of the burner seal relative to the burner seal retainer about the burner seal axis, wherein the combustor further comprises a retainer bracket configured to retain each of the retainer half-rings together to enclose the inlet flange, the retainer bracket including an annular mount ring that extends axially from a first end to a second end fixed to the dome panel and a retention panel fixed to the first end of the annular mount ring and that extends radially inward toward the burner seal axis, wherein the retention panel of the retainer bracket has an aft surface engaged with a forward surface of the mount plate of each retainer half-ring, and wherein a second anti-rotation pin extends axially through the retention panel of the retainer bracket, the mount plate of at least one retainer half-ring, and into the dome panel.

4. The combustor of claim 1, wherein each retainer half-ring is joined directly to the dome panel to couple the burner seal to the dome panel in the fixed axial position.

5. The combustor of claim 1, wherein the distal end is spaced apart from a radially inner surface of the link segment to provide a gap between the inlet flange and the link segment to accommodate the expansion rate of the burner seal retainer.

6. The combustor of claim 1, wherein the mount plate has a proximal end and an inner radius is defined between the burner seal axis and the proximal end, and the inner radius of the mount plate is less than a radius of the fuel nozzle aperture.

7. A method of retaining a burner seal to a dome panel in a combustor of a gas turbine engine, the method comprising, forming the combustor from metallic materials to define an interior cavity, the combustor including a dome panel formed to include at least one fuel nozzle aperture that opens into the interior cavity, coupling a heat shield to an axially-aft side of the dome panel, the heat shield having a heat-shield aperture, inserting the burner seal through the fuel nozzle aperture and the heat-shield aperture from an aft side of the dome panel, the burner seal comprising ceramic matrix composite materials, and retaining the burner seal to an axially forward surface of the dome panel in a fixed axial position while allowing the burner seal to float in radial and circumferential directions to accommodate thermal growth of the dome panel at an expansion rate not equal to an expansion rate of the burner seal, wherein the burner seal includes: (i) a burner seal body that extends circumferentially around a burner seal axis and axially from an axially-forwardmost, inlet end to an outlet end spaced axially from the axially-forwardmost, inlet end and (ii) an inlet flange at the axially-forwardmost, inlet end that extends radially outward from the burner seal body relative to the burner seal axis and circumferentially around the burner seal axis, and the step of retaining the burner seal includes engaging the inlet flange with a burner seal retainer without fixing the burner seal in the radial and circumferential directions, and wherein the step of engaging the inlet flange includes enclosing the inlet flange with a first retainer half-ring formed to include a first semi-circular channel and a second retainer half-ring formed to include a second semi-circular channel, the inlet flange being received in the first and second semi-circular channels when the burner seal retainer is installed on the burner seal and the first and second retainer half-rings engaged with the forward surface of the dome panel to block movement of the burner seal axially aft through the fuel nozzle aperture, wherein each retainer half-ring includes a mount plate coupled to the axially forward surface of the dome panel, a link segment coupled to the mount plate and arranged to extend axially forward from the mount plate, and a retainer plate coupled to the link segment and spaced apart from the mount plate to provide the first and second semi-circular channels axially between the mount plate and the retainer plate, wherein a first anti-rotation pin extends axially through the retainer plate of at least one of the retainer half-rings and into the inlet flange to block rotation of the burner seal relative to the burner seal retainer about the burner seal axis, wherein the combustor further comprises a retainer bracket configured to retain each of the retainer half-rings together to enclose the inlet flange, the retainer bracket including an annular mount ring that extends axially from a first end to a second end fixed to the dome panel and a retention panel fixed to the first end of the annular mount ring and that extends radially inward toward the burner seal axis, wherein the retention panel of the retainer bracket has an aft surface engaged with a forward surface of the mount plate of each retainer half-ring, and wherein a second anti-rotation pin extends axially through the retention panel of the retainer bracket, the mount plate of at least one retainer half-ring, and into the dome panel.

* * * * *